US009601243B2

(12) United States Patent
Wosgien et al.

(10) Patent No.: US 9,601,243 B2
(45) Date of Patent: Mar. 21, 2017

(54) CONTACT ELEMENT FOR VARISTOR

(71) Applicant: PHOENIX CONTACT GMBH & CO. KG, Blomberg (DE)

(72) Inventors: Joachim Wosgien, Lohne (DE); Markus Philipp, Berkatal (DE); Jan-Erik Schmutz, Detmold (DE); Rainer Durth, Horn-Bad Meinberg (DE)

(73) Assignee: PHOENIX CONTACT GMBH & CO. KG (DE)

( * ) Notice: Subject to any disclaimer, the term of this patent is extended or adjusted under 35 U.S.C. 154(b) by 136 days.

(21) Appl. No.: 14/405,492

(22) PCT Filed: May 27, 2013

(86) PCT No.: PCT/EP2013/001556
§ 371 (c)(1),
(2) Date: Dec. 4, 2014

(87) PCT Pub. No.: WO2013/182276
PCT Pub. Date: Dec. 12, 2013

(65) Prior Publication Data

US 2015/0170803 A1 Jun. 18, 2015

(30) Foreign Application Priority Data

Jun. 6, 2012 (DE) ..... 10 2012 011 241

(51) Int. Cl.
*H01C 1/14* (2006.01)
*H01C 1/142* (2006.01)
(Continued)

(52) U.S. Cl.
CPC ..... *H01C 1/14* (2013.01); *H01C 1/142* (2013.01); *H01C 7/10* (2013.01); *H01C 7/126* (2013.01)

(58) Field of Classification Search
CPC ..... H01C 1/14
See application file for complete search history.

(56) References Cited

U.S. PATENT DOCUMENTS 6,249,412 B1 * 6/2001 Caffrey ..... H01C 1/14 361/103
2003/0038706 A1 * 2/2003 Nakatsu ..... H02M 7/003 338/49

(Continued)

FOREIGN PATENT DOCUMENTS

| | | |
|---|---|---|
| CH | 660812 A5 | 6/1987 |
| EP | 0905839 A1 | 3/1999 |
| EP | 1826781 A1 | 8/2007 |

OTHER PUBLICATIONS

International Search Report prepared by the European Patent Office on Sep. 6, 2013, for International Application No. PCT/EP2013/001556.

*Primary Examiner* — James Harvey
(74) *Attorney, Agent, or Firm* — Sheridan Ross P.C.

(57) ABSTRACT

The invention relates to a contact for a varistor (VAR), comprising a first feed element (ZL1) which is suitable for connecting to a supply network, and a plurality of electrical connection points (V1, V2 . . . VN) which are at a distance from one another and are suitable for making multiple connections to a pole of said varistor (VAR). The plurality of electrical connection points (V1, V2, . . . VN) and the first feed element (ZL1) are electrically interconnected, and the plurality of electrical connection points (V1, V2, . . . VN) are each designed with fuse elements (F1, F2, . . . FN) such that local shorting of one part of the varistor (VAR) can be achieved by disconnecting the local electrical connection point (n) (V1, V2, . . . VN) in question.

16 Claims, 9 Drawing Sheets

(51) Int. Cl.
*H01C 7/12* (2006.01)
*H01C 7/10* (2006.01)

(56) References Cited

U.S. PATENT DOCUMENTS

2008/0117555 A1* 5/2008 Wilson ..... H05K 1/0256
361/13
2015/0170803 A1* 6/2015 Wosgien ..... H01C 1/142
338/21

* cited by examiner

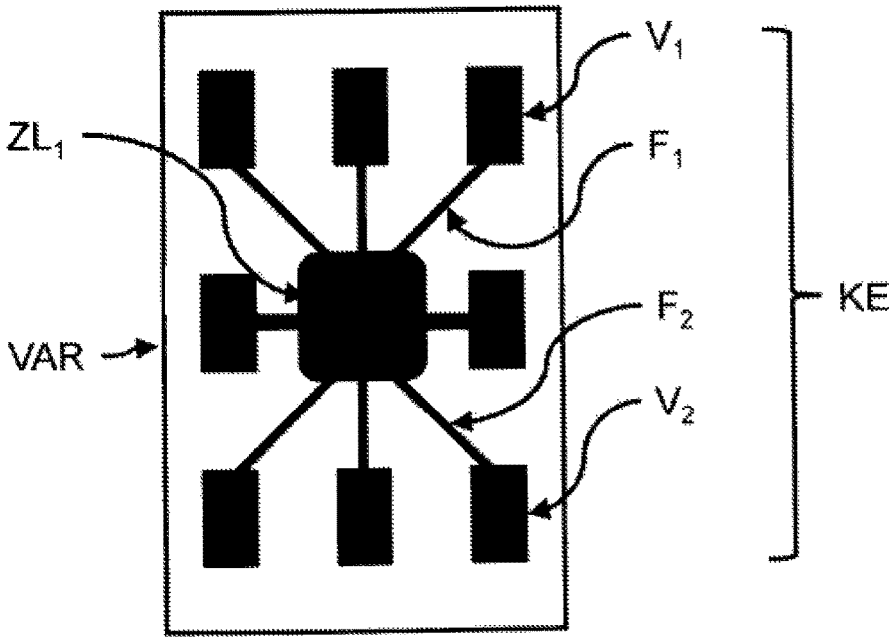
Fig. 11
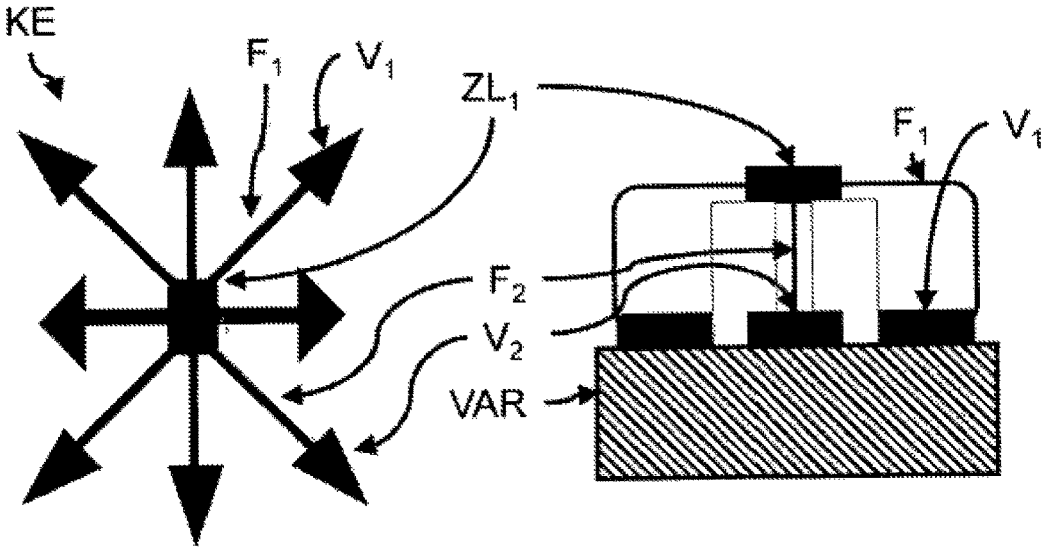
Fig. 12a
Fig. 12b

CONTACT ELEMENT FOR VARISTOR

CROSS REFERENCE TO RELATED APPLICATIONS

This application is a national stage application under 35 U.S.C. 371 and claims the benefit of PCT Application No. PCT/EP2013/001556 having an international filing date of May 27, 2013, which designated the United States, which PCT application claimed the benefit of German Patent Application No. PA 102012011241.6 filed Jun. 6, 2012, the disclosure of both the above-identified applications are incorporated herein by reference.

BACKGROUND

The invention relates to a contact element for a varistor. Varistors are known from the prior art.

Varistors provide a voltage-independent resistance in electrical circuits. Varistors are therefore used in a wide range of applications, typically in order to discharge overvoltage above a certain threshold voltage, thus preventing the overloading or damaging of a subsequent device. One example of such overvoltage is voltage that can occur as a result of lightning.

The varistor generally contains a granular metal oxide, e.g., zinc oxide and/or bismuth oxide and/or manganese oxide and/or chromium oxide and/or silicon carbide, which is almost always inserted in the form of (sintered) ceramic between two planar electrodes as supply elements $ZL_1$, $ZL_2$. One exemplary varistor VAR is shown in FIG. 1. It has a first supply line $ZL_1$ on one side and a second supply line $ZL_2$ on an opposing side.

Typically, the individual grains possess varying conductivity. Boundary layers are formed at the respective grain boundaries, that is, at the contact points of the grains. It can be determined that, as the thickness increases, the number of grain boundaries increases, and hence the threshold voltage as well. If voltage is applied to the supply elements $ZL_1$, $ZL_2$, an electrical field is formed. Depending on the voltage, the boundary layers are broken down and the resistance decreases.

Due to the material characteristics of the varistor, neither the distribution of current nor the breakdown of the boundary layers is a uniform process; rather, localized current paths are formed, for example current paths $S_1$, $S_2$, that reach the conductive state at different speeds. For example, in FIG. 1, the current path $S_1$ becomes conductive more quickly than the current path $S_2$, since a lower voltage (200 V, for example) needs to be overcome on the current path $S_1$ than on current path $S_2$ (300 V, for example).

As a result of the material characteristics, and due to the use of the varistor, leakage currents occur. While these leakage currents are very usually small, they can lead in some circumstances to substantial heating of the component, thus posmg a fire hazard. To counteract this, a temperature sensor is typically used which actuates a switch TS when a certain temperature is exceeded. This is shown, for example, in FIG. 2. However, temperature sensors can only be used to detect slow events. Quick heating such as that which occurs when a high voltage is applied, for example, leads to a greatly delayed rise in temperature at the temperature sensor due to the necessary and known slow heat conductance, so that the varistor would generally already be destroyed. The selectivity is also generally limited here; that is, only small currents can be cut off.

Such an energy input can occur, for example, as a result of overvoltage occumng over an extended period, thus leading to an interconnection of the varistor VAR, upon which the short-circuit current of the network is discharged via the varistor. In this case, substantial heating of the varistor VAR occurs, and there is a fire hazard. Furthermore, the varistor VAR can be damaged in this way to the extent that the varistor is explosively shorted out.

Typically, varistors VAR are therefore provided with an upstream fuse F that is dimensioned such that the maximum impulse current load Im of the varistor VAR can still be discharged, but a cut-out is brought about upon exceeding of the maximum impulse current load Im. However, a high impulse current capacity of the fuse is always also associated with a high fuse rating. That is why an interruption of the (starting) short-circuit current only occurs comparatively late in the event of a fault.

Nonetheless, damage occurs in varistors VAR time and time again that cannot be detected by the abovementioned elements, that is, currents occur that can no longer be shunted off by the selectivity of the thermal cut-out TS but that are too small for an upstream fuse F.

SUMMARY

In view of this background, there is a desire to minimize the fuse rating of the upstream fuse F while maintaining maximum surge withstand current.

It is the object of the invention to provide a contact element for a varistor that avoids one or more of these drawbacks.

This object is achieved by the features of claim 1. Advantageous developments are also the subject of the dependent claims.

BRIEF DESCRIPTION OF THE DRAWINGS

FIG. 12*a* shows an exemplary schematic view of a contact of a varistor according to an embodiment of the invention, and FIG. 12*b* shows an exemplary side schematic sectional view of a contact of a varistor according to an embodiment of the invention.

DETAILED DESCRIPTION

The invention is explained in further detail below with reference to the figures. The invention proposes a novel contact for a varistor VAR as shown schematically in FIG. 3. This contact has a first supply element $ZL_1$ that is suitable for connection to a power grid and a plurality of electrical connection points $V_1$, $V_2$, VN, which are spaced apart from each other and capable of multiply contacting a pole of the varistor VAR. An exemplary arrangement of connection points $V_1$, $V_2$, VN is shown in FIGS. 4*a* and 4*b*.

The plurality of electrical connection points $V_1$, $V_2$, VN and the first supply element $ZL_1$ are in electrical contact with each other.

Each of the plurality of electrical connection points $V_1$, $V_2$, VN is designed with a fuse $F_1$, $F_2$, FN, so that a local shorting-out of a part of the varistor VAR is brought about through a separation of the local electrical connection point(s) involved. An exemplary arrangement of fuses $F_1$, $F_2$, . . . FN is shown, in tum, in FIG. 3.

Figure 1:
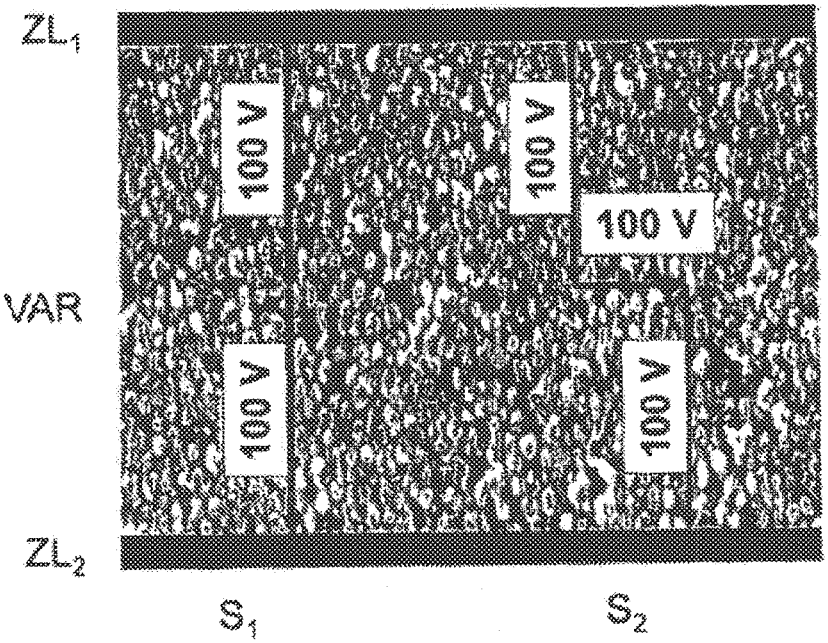
Fig. 1 (PRIOR ART)
FIG. 1 shows a basic configuration and functionality of a varistor.

The previously monolithic varistor VAR (framed by a dotted line) thus becomes a virtual parallel circuit of sub-varistors VAR'i, VAR'2, . . . , VAR'N. Here, the invention makes use of the isotropy shown in FIG. 1, which has the effect that any extension of the current path between the supply elements $ZL_1$, $ZL_2$ leads to a greater voltage drop, i.e., the resistance increases as well, so a current flow with a parallel component, such as via $S_2$, for example, will tend to be small.

It should be noted here that the virtual parallel circuit provided by the invention is advantageous in comparison with real varistor parallel circuits, since the sub-varistors VAR'i, VAR'2, . . . VAR'N of the virtual parallel circuit provide substantially lower component distribution than could be provided with conventional and economically reasonable effort with real varistors. In addition, a real parallel circuit would require substantially more space than the virtual parallel circuit. Greater required installation space is typically regarded as disadvantageous.

Figure 2:
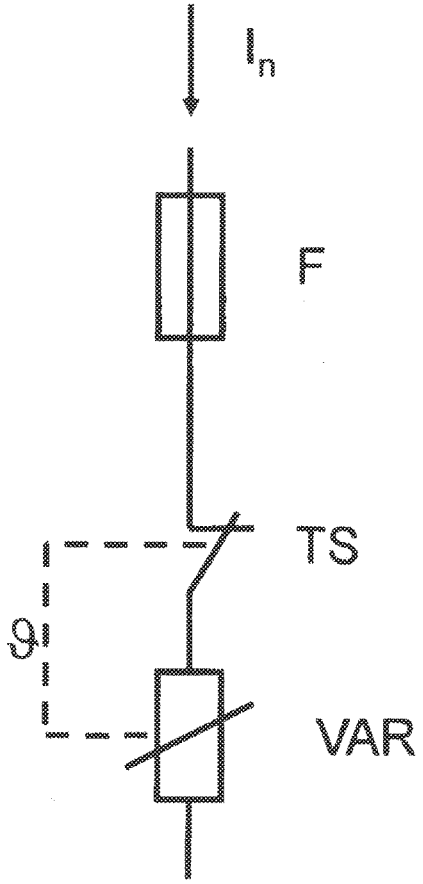
Fig. 2 (PRIOR ART)
FIG. 2 shows a typical circuit arrangement of a varistor according to the prior art.
Figure 3:
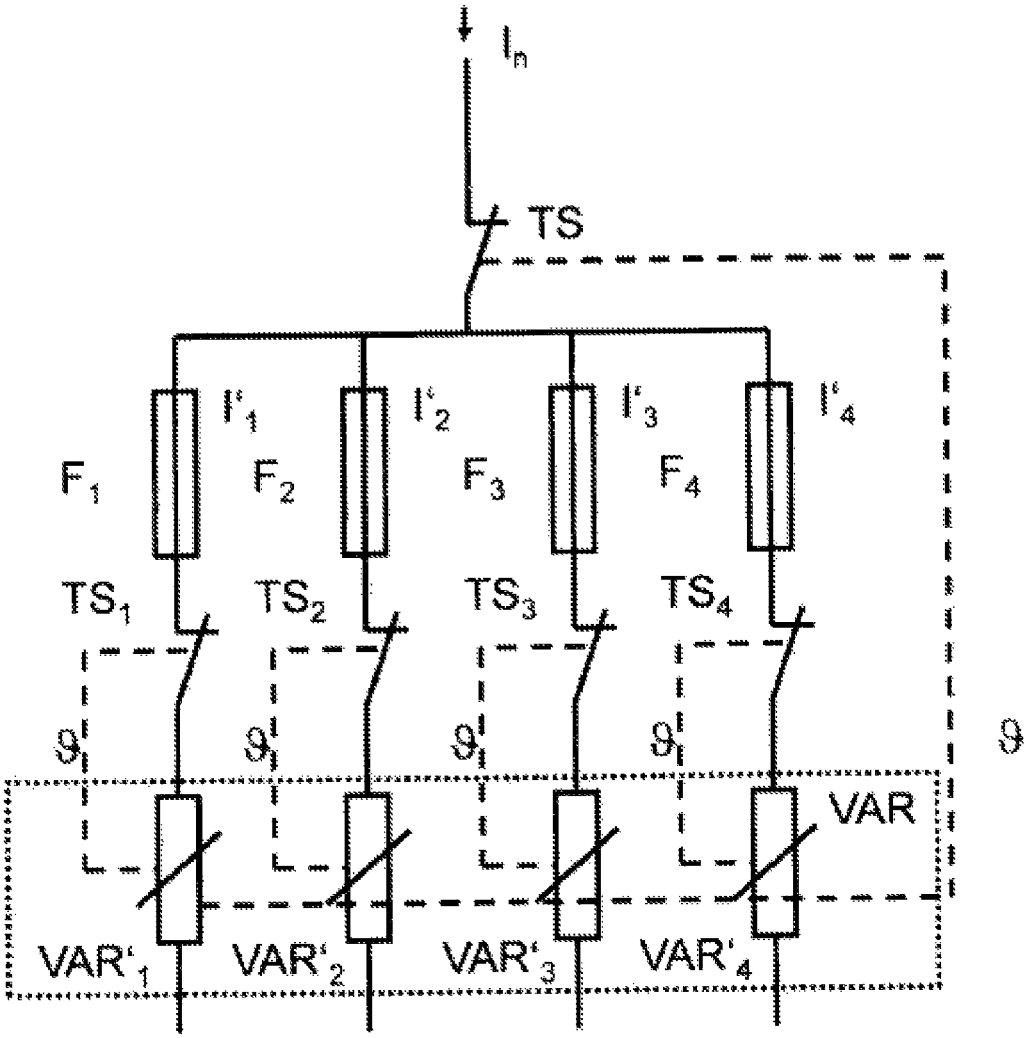
FIG. 3 shows a circuit arrangement of a varistor according to an embodiment of the invention.
Figure 4A:
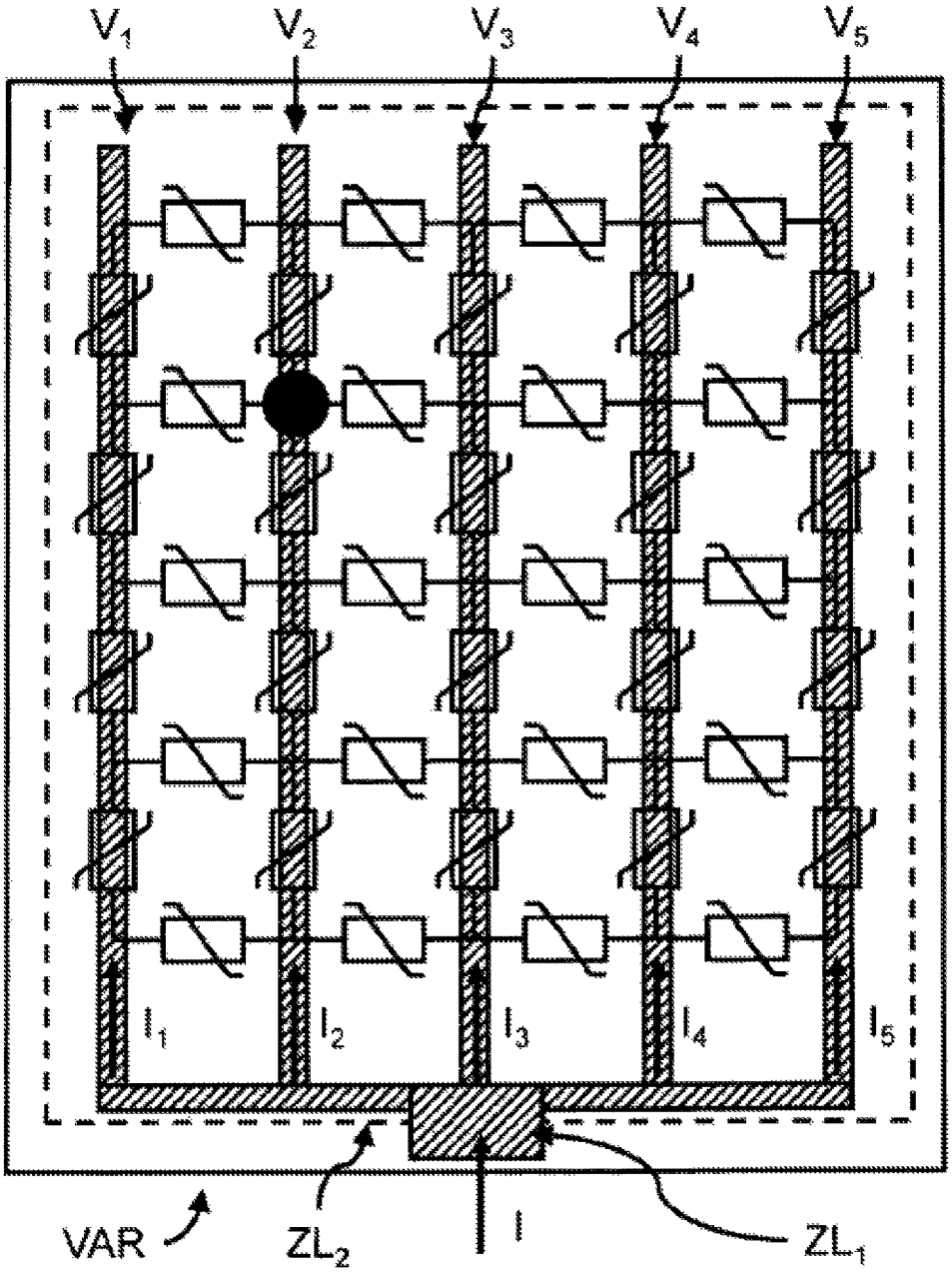
FIG. 4*a* shows an exemplary schematic view of a contact of a varistor.
Figure 4B:
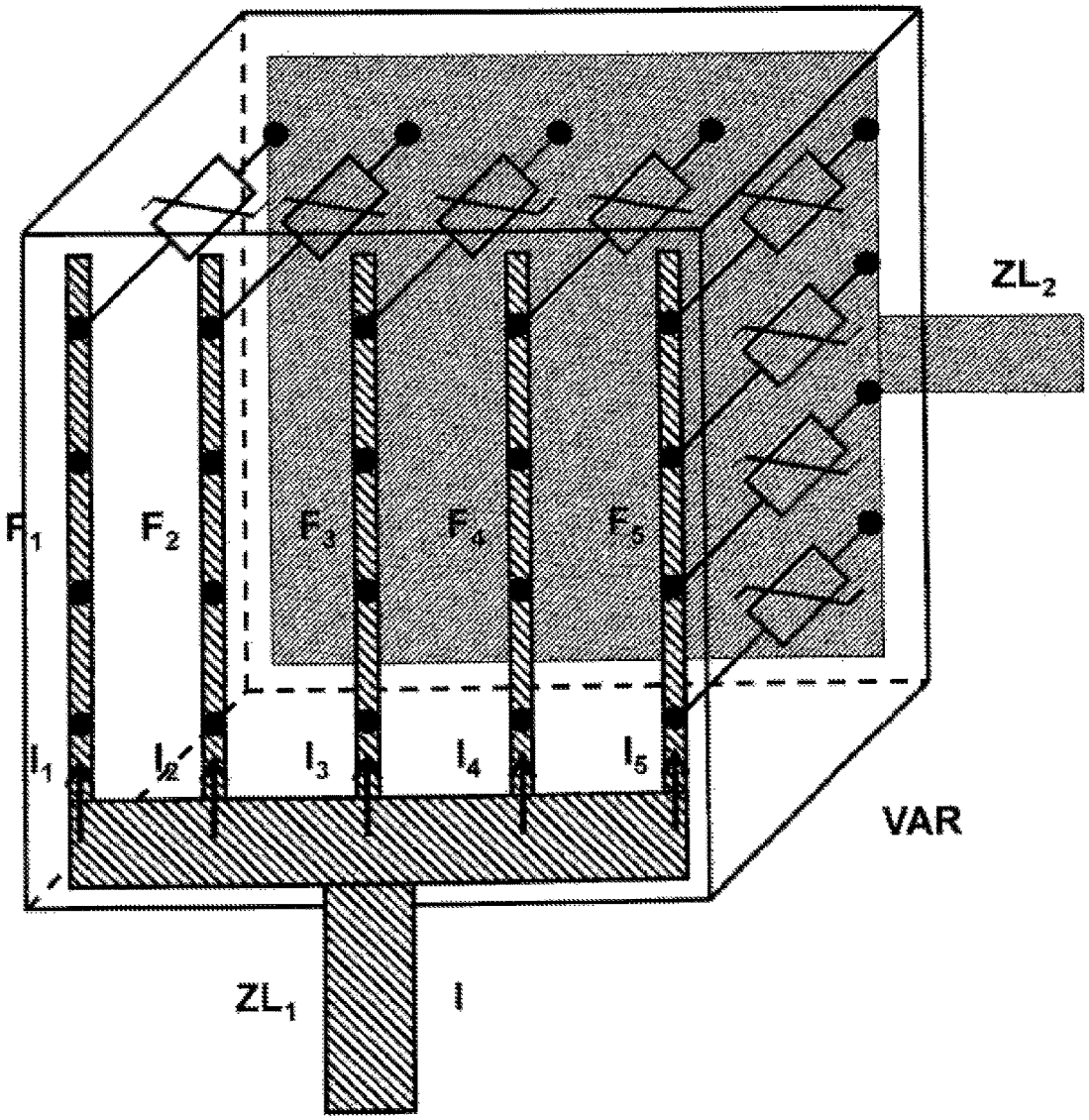
FIG. 4*b* shows an exemplary perspective schematic view of a contact of a varistor according to an embodiment of the invention, FIGS. 5 to 9 each show an exemplary side schematic sectional view of a contact of a varistor according to an embodiment of the invention, FIGS. 10 and 11 each show an exemplary schematic view of a contact of a varistor according to an embodiment of the invention.

For example, it is possible in this way to implement a varistor-fuse series connection (VAR-F) as shown in FIG. 2 in a virtual parallel circuit as shown in FIG. 3. In FIG. 2, for example, if one were to use a fuse F of about 125 A at a rated surge current of 40 kA, the rated surge current could then be distributed across 4 given connections in the virtual parallel circuit according to FIG. 3 at 10 kA per virtual sub-varistor VAR'i, VAR'2, VAR13, VAR14, and the fuse $F_1$, $F_2$, $F_3$, $F_4$ could be selected to be correspondingly smaller—35 A, for example.

FIG. 4*a* shows an exemplary schematic view of a contact of a varistor, and FIG. 4*b* shows an exemplary schematic perspective view of a contact of a varistor according to one embodiment of the invention. A planar supply element $ZL_2$, framed by a dashed line, is located on one side, in this case the underside. Above that is located the actual varistor VAR, and above that in tum is located a supply element $ZL_1$ having five conductors. Each of the conductors thus forms one of the abovementioned electrical connection points $V_1$, V2, V3, V4, Vs. In addition, each of the conductors forms one of the abovementioned fuses $F_1$, $F_2$, . . . Fs. If a current I now flows into the supply element $ZL_1$, the current will be distributed to the five conductors and thereby to the connection points $V_1$, $V_2$, $V_3$, $V_4$, $V_5$ and fuses $F_1$, $F_2$, . . . $F_5$. If the varistor is substantially homogeneous, which must generally be assumed, the current I will be uniformly distributed, so that $I_1=I_2=I_3=I_4=I_5$. The homogeneity is indicated by the longitudinally and transversely linked varistor symbols in FIG. 4*a*.

Current distribution also occurs in the event of an impulse current, so that each of the current paths need only bear one partial impulse current $I_1$, $I_2$, $I_3$, $I_4$, $I_5$. Fuses F can therefore now be integrated into each of the current paths, which possess lower surge current-carrying capacity, the melting integral generally being selected such that it is only slightly greater than the $I^2t$ value of the partial impulse, i.e., such that the respective fuse is capable of sustaining a partial impulse without being destroyed. The $I^2t$ value correlates with the rating of the fuse. Since the $I^2t$ value is now smaller, fuses with lower ratings can be used.

In other words, the fuses are designed such that each has an $I^2t$ that is given by the maximum permissible impulse current load with respect to the contacting varistor segment.

If the varistor comes to have low impedance somewhere, as a result of damage, for example, this generally only occurs in a localized manner. For example, such a point is marked by a black dot in FIG. 4*a* at the connection point $V_2$. However, now the current flow changes. If the varistor VAR comes to have low impedance at the indicated position, the current now flows substantially over that place, i.e., $I=I_2$ and $I_1=I_3=I_4=I_5=0A$. However, since the fuse can be designed to be smaller as described above, the current is not sufficient to initiate the severing of the fuse of the connection point $V_2$. That is, severing can now be achieved with a substantially smaller short-circuit current, and generally more quickly at that.

Moreover, only one sub-region—connection point $V_2$—is removed from the parallel circuit, while the remaining sub-regions remain active, and thus protection can be provided at least at a reduced capacity. That is, if many connection points with their respective fuses are made available, the capacity drops only slightly. It can be approximately assumed here that the capacity is dependent on the surface area of the active connection points.

Although a thermal separation $TS_1$, $TS_2$, $TS_3$, $TS_4$—as shown in FIG. 3—can now be provided at each of the virtual varistors, it is also possible, alternatively or in addition, to provide a common thermal separation by means of a thermally activatable switch TS.

Figure 5:
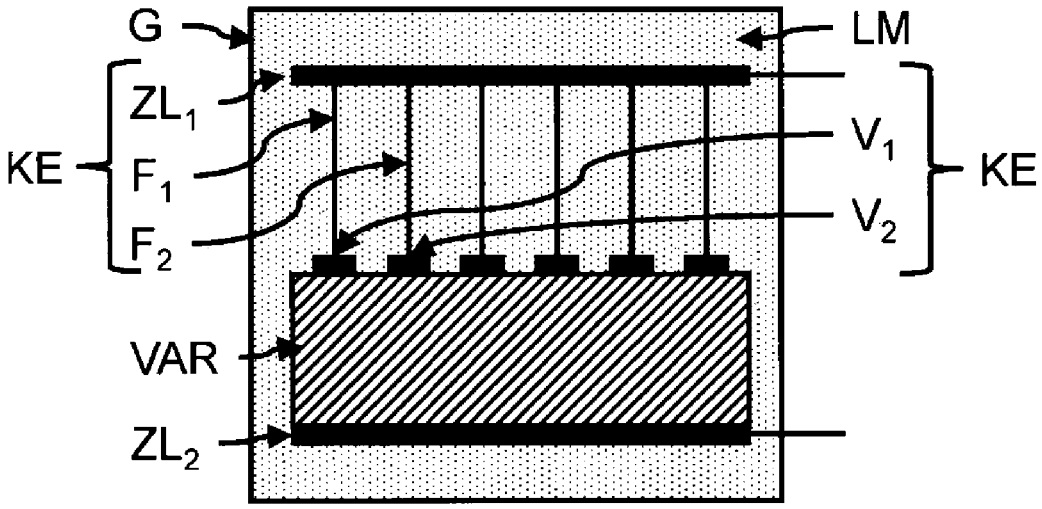

FIG. 5 shows an exemplary side schematic sectional view of a contact of a varistor VAR according to an embodiment of the invention. It is assumed here that the arrangement is located in a housing G. The housing G can be compression-proof in order to protect other systems from the explosion-like destruction of the varistor, which cannot be ruled out.

Moreover, the housing G can be filled with an extinguishing agent LM. Examples of suitable extinguishing agents are POM or quartz sand. The electrically insulating extinguishing agent surrounds at least segments of the fuses $F_1$, $F_2$, . . . , FN.

The connection points $V_1$, $V_2$ are connected here to the supply element $ZL_1$ by means of thin electrical connections. These thin electrical connections can be embodied as fuse elements, for example, and thus perform the function of the fuses $F_1$, $F_2$.

Figure 13:
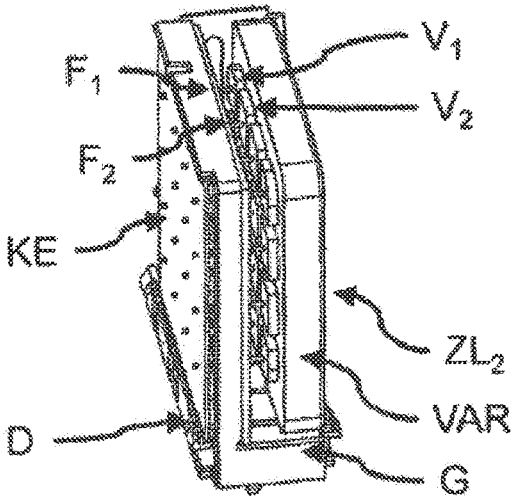
FIG. 13 shows an exemplary embodiment according to the diagram from FIG. 5.

One possible embodiment of the diagram from FIG. 5 is shown in FIG. 13.

Figure 6:
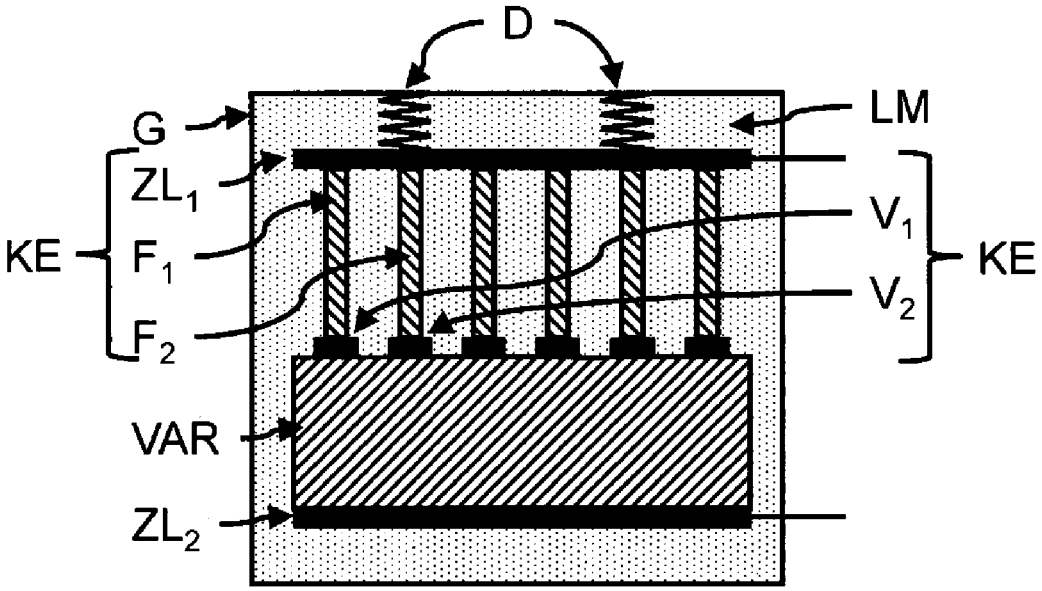

In contrast, SMD fuses or fine fuses are shown in FIG. 6 between the supply element $ZL_1$ and the respective connection points $V_1$, $V_2$. To ensure the electrical contact, the supply element $ZL_1$ can be held in electrical contact with the fuses by means of one or more springs D.

That is, the fuses are attached nonpositively and/or by adhesion and/or positively between the supply element $ZL_1$ and the varistor VAR.

Figure 7:
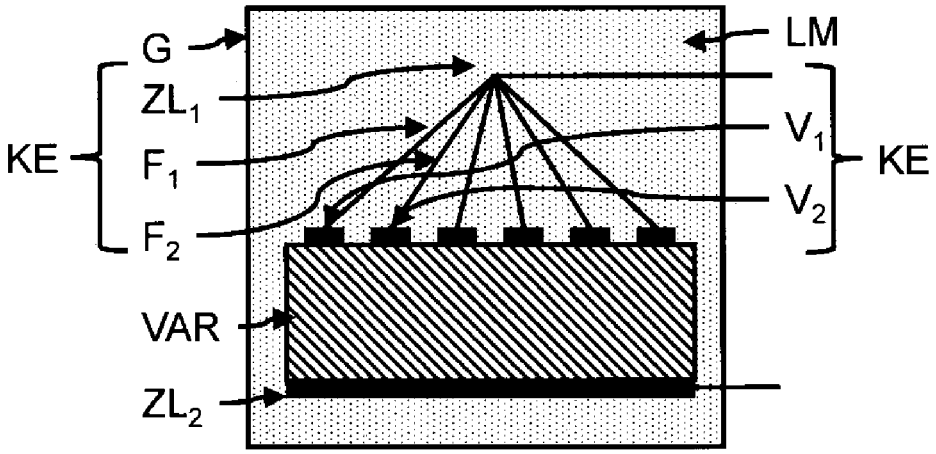

In contrast to FIG. 5, FIG. 7 shows the connection points grouped together at a point.

Figure 8:
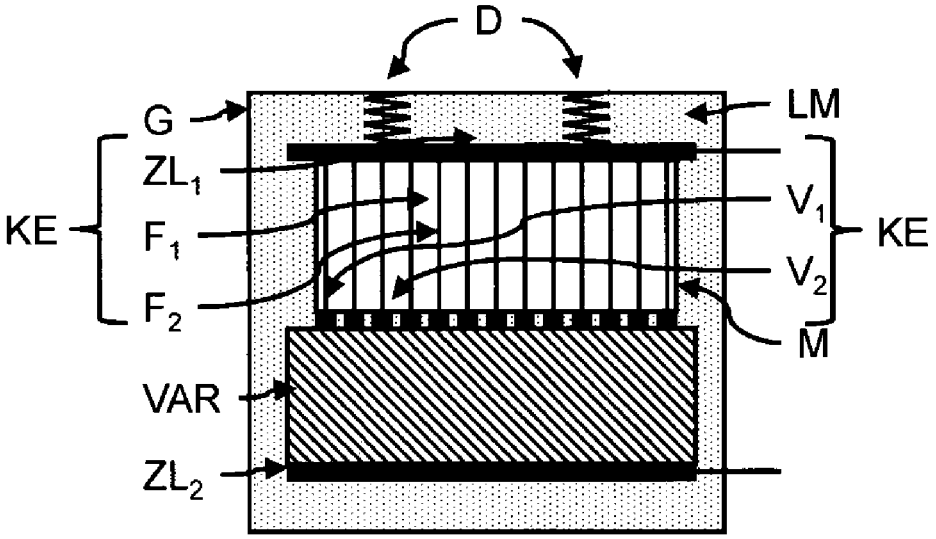

In contrast to FIG. 6, a kind of prefabricated, disc-like matrix M is introduced in FIG. 8. The matrix M can have for example fuse wires $F_1$, $F_2$ that were manufactured for example in a drawing process, and inserted into an insulation matrix. It is also possible to use as the matrix M a carrier material P, for example a circuit board, with vias, in which case the vias serve as fuses $F_1, F_2, \ldots, F_N$. Correspondingly, a connection point V can be allocated to each of the individual vias F; that is, on a two-layer circuit board P, a first layer can be used for the supply element $ZL_1$, while the second layer is used to construct the connection points.

Figure 9:
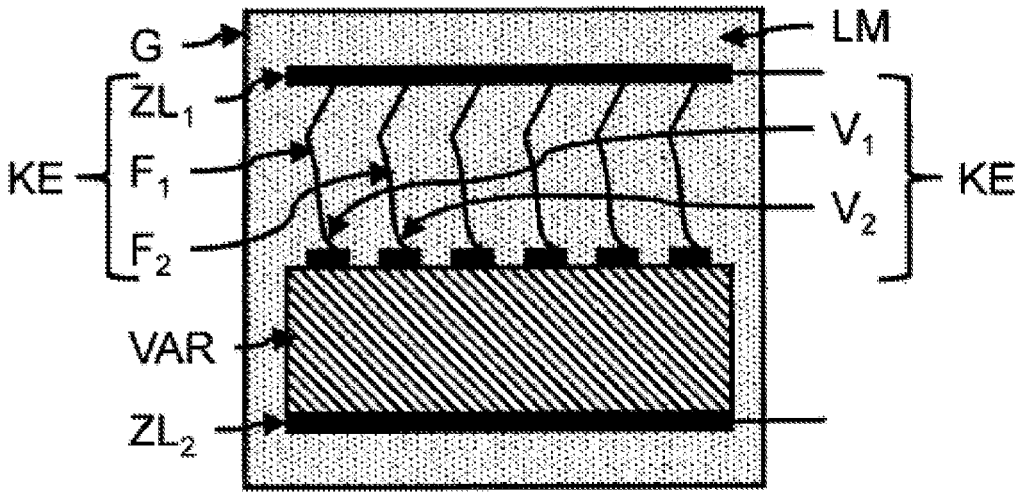

In the embodiment of FIG. 9, the individual fuses $F_1$, $F_2, \ldots, F_N$ are composed of spring-like connection points which are connected to the varistor in an electrically conductive but thermally separable manner. Here the separation is produced by cutting the connection.

The embodiments presented can readily be embodied as contact elements KE in order to be connected to a varistor VAR.

The invention can also be embodied in a varistor ensemble having a varistor VAR and a contact according to the invention.

Without restricting the generality, the individual connection points can have different dimensions and, accordingly, have different impedance.

Figure 10:
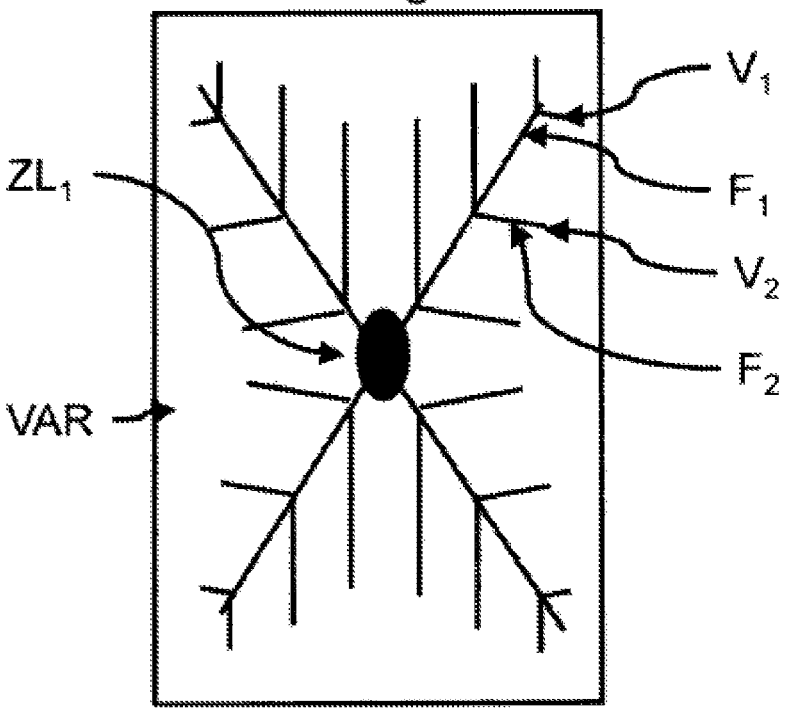

FIG. 10 shows an example of a tree-like contact element KE. It has a contact point for the supply element $ZL_1$ and numerous branches. The individual branches can establish contact to the varistor VAR at their end points, and the branches themselves can, in tum, serve as fuses F. Such a contact element KE can readily be manufactured by stamping.

A similar arrangement can be seen in FIG. 11. Here, the connection points are larger. Such a contact element KE can be manufactured by for example stamping and bending. For example, as shown in FIGS. 12*a* and 12*b*, a spring-like structure can also be produced by bending.

| List of Reference Symbols | |
|---|---|
| contact element | KE |
| varistor | VAR, VAR'1, VAR'2, VAR'3, VAR'4 |
| electrical connection points | $V_1, V_2, \ldots, V_N$ |
| supply elements | $ZL_1, ZL_2$ |
| carrier material, circuit board | P |
| fuses | $F, F_1, F_2, \ldots, F_N$ |
| extinguishing agent | LM |
| force | D |
| (compression-proof) housing | G |
| matrix | M |
| current path | $S_1, S_2$ |
| switch | $TS, TS_1, TS_2, TS_3, TS_4$ |
| maximum impulse current load | $I_m$ |

The invention claimed is:

1. A contact for a varistor, comprising:

a first supply element that is suitable for connecting to a power grid; and a plurality of electrical connection points which are spaced apart from each other and capable of multiply contacting a pole of the varistor, wherein the plurality of electrical connection points and the first supply element are electrically connected to each other, and wherein the plurality of electrical connection points is configured with fuses, such that a local shorting-out of a part of the varistor is brought about through a separation of an affected local electrical connection point(s).

2. The contact as set forth in claim 1, wherein the plurality of electrical connection points is arranged on a carrier material.

3. The contact as set forth in claim 1, wherein the plurality of electrical connection points is arranged on a carrier material in the manner of a conductive path.

4. The contact as set forth in claim 1, wherein each fuse is respectively arranged between one or more of the plurality of connection electrical points and the first supply element.

5. The contact as set forth in claim 4, wherein each fuse has a fuse element.

6. The contact as set forth in claim 4, wherein the fuses are surrounded at least in segments by an electrically insulating extinguishing agent.

7. The contact as set forth in claim 4, wherein the fuses are surrounded at least in segments by POM or quartz sand.

8. The contact as set forth in claim 1, wherein the fuses are designed such that each fuse has an $I^2t$ that is based on the maximum permissible impulse current load with respect to a respective contacting electrical connection pointvaristor segment.

9. A varistor ensemble having a varistor having the contact as set forth in claim 1.

10. The varistor ensemble as set forth in claim 9, wherein the contact and the varistor are arranged in a housing.

11. The varistor ensemble as set forth in claim 9, wherein the varistor and the contact are held in contact with each other by means of spring force.

12. The varistor ensemble as set forth in claim 9, wherein a connection point of the plurality of electrical connection points or several of the plurality of electrical connection points have a different impedance than others of the plurality of electrical connection points.

13. The varistor ensemble as set forth in claim 9, wherein the fuses are attached by at least one of nonpositively, adhesion, and positively between the supply element and the varistor.

14. The contact as set forth in claim 1, further comprising:

a first temperature switch connected between the first supply element and the fuses; and a plurality of second temperature switches connected between the fuses and the plurality of electrical connection points.

15. The contact as set forth in claim 1, further comprising:

a planar second supply element connected to the plurality of electrical connection points, wherein the first supply element includes a plurality of conductors electrically connected to respective ones of the plurality of electrical connection points.

16. The contact as set forth in claim 1, wherein the fuses converge to a single connection point on the first supply element.

* * * * *